United States Patent [19]

Abe

[11] 4,236,879

[45] Dec. 2, 1980

[54] HERMETIC MOTOR-COMPRESSOR

[75] Inventor: Nobuo Abe, Tochigi, Japan

[73] Assignee: Hitachi, Ltd., Japan

[21] Appl. No.: 897,503

[22] Filed: Apr. 18, 1978

[30] Foreign Application Priority Data

Apr. 20, 1977 [JP] Japan ..... 52-44475

[51] Int. Cl.[3] ..... F04B 17/00

[52] U.S. Cl. ..... 417/368; 417/372; 417/902; 415/88; 184/6.18; 29/149.5 R

[58] Field of Search ..... 415/88; 417/368, 372, 417/902; 184/6.18

[56] References Cited

U.S. PATENT DOCUMENTS

| | | | |
|---|---|---|---|
| 3,049,285 | 8/1962 | Doeg | 417/372 |
| 3,162,360 | 12/1964 | Privon | 417/372 |
| 3,194,490 | 7/1965 | Roelsgaard | 415/88 |
| 3,253,776 | 5/1966 | Parker | 417/372 X |
| 3,295,753 | 1/1967 | Butts et al. | 417/902 X |
| 3,584,980 | 6/1971 | Cawley | 417/372 |
| 3,848,702 | 11/1974 | Bergman | 184/6.18 X |

*Primary Examiner*—Richard E. Gluck
*Attorney, Agent, or Firm*—Craig and Antonelli

[57] ABSTRACT

A small power hermetic motor-compressor suitable for use in an electric refrigerator having a compression mechanism section and a driving electric motor section combined together and confined in a closed container. The compression mechanism section and the driving electric motor section are connected to each other by means of a rotor shaft manufactured through a plastic working of a single steel pipe blank. The rotor shaft has a journal section adapted to be slidingly held by a cooperative bearing section provided on the stationary part of the compressor. A plurality of oil grooves of a relatively small length are press-formed on the outer peripheral surface of the rotor shaft from the outside thereof. At least one of the oil grooves is provided with an oil passage bore formed through the thickness of the rotor shaft, so that the lubricating oil sucked up along the inner peripheral wall of the rotor shaft is allowed to come out of the rotor shaft and get into the oil groove. The journal section or the cooperative bearing surface may be provided with at least one oil holding section connecting the adjacent oil grooves for the delivery of the oil from one to the other groove. The journal section can have a gas purging port for expelling the gas or vapor of the oil out of the bearing section.

1 Claim, 17 Drawing Figures

HERMETIC MOTOR-COMPRESSOR

BACKGROUND OF THE INVENTION

The present invention broadly relates to a hermetical motor-compressor of a relatively small capacity, having a compression mechanism confined within a closed container, suitable for use as the compressor of an electric refrigerator. More specifically, the present invention is concerned with an improved construction for feeding lubricating oil having a specific form of oil conduits or grooves of a rotor shaft of the compressor of the type stated above, especially when the rotor shaft is made basically by a plastic working of a single steel pipe, as well as an effective bearing structure making use of the rotor shaft.

Conventionally, it has been proposed to produce the rotor shafts of hermetical compressors efficiently by plastic working of single steel pipes. However, unfortunately, these rotor shafts have had various drawbacks or shortcomings, especially concerning the difficulty in forming the oil grooves or conduits therein, as will be detailed later.

SUMMARY OF THE INVENTION

It is therefore an object of the invention to provide a hermetical motor-compressor, having a rotor shaft, which can efficiently be fabricated by a plastic working of a steel pipe and which has improved forms of oil grooves or conduits and sliding parts easy to process.

To this end, according to the invention, there is provided a hermetic motor-compressor of a relatively small capacity, adapted to be suitably incorporated in an electric refrigerator or the like, having a compression mechanism section and a driving motor section combined together and confined in a closed container, the compression mechanism section and the driving section being connected to each other through a rotor shaft manufactured by a plastic working of a single steel pipe blank and having a journal section adapted to be slidingly held by a bearing section formed on a stationary part of the compressor, characterized in that the rotor shaft is provided with a plurality of oil grooves of a small length press-formed on its outer peripheral surface from the outside thereof, at least one of the oil groove having an oil passage bore communicating the inside and the outside of the shaft to deliver the lubricating oil from the inside to the outside oil groove of the rotor shaft.

The above and other objects, as well as advantageous features of the invention will become clear from the following description of the preferred embodiments taken in conjunction with the accompanying drawings.

DESCRIPTION OF THE PREFERRED EMBODIMENTS

Before turning to the description of the preferred embodiments, an explanation will be made here as to the construction of conventional hermetic motor-driven compressor, with specific reference to FIGS. 1 to 6 inclusive.

Figure 1:
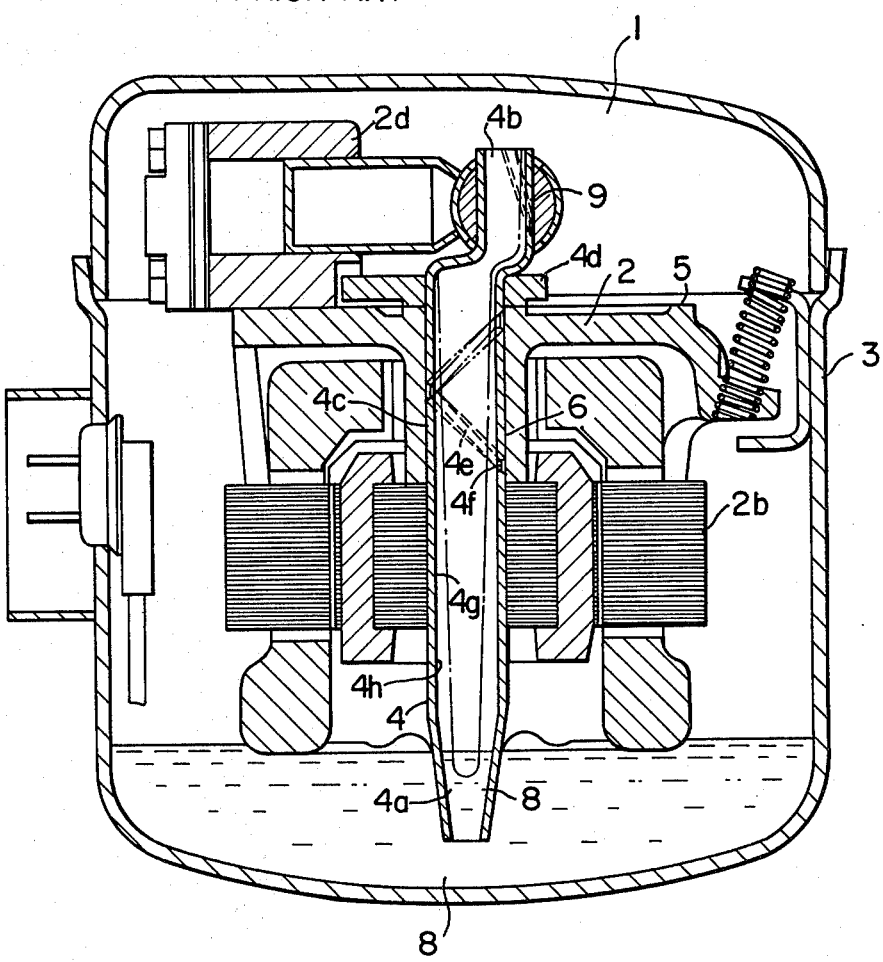
FIG. 1 PRIOR ART
FIG. 1 is a side elevational sectional view of a typical example of conventional hermetic motor compressors.
Figure 2:
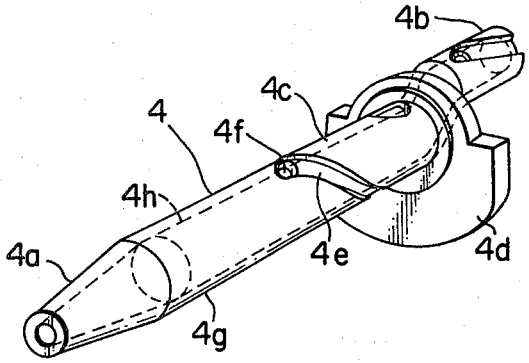
FIG. 2 PRIOR ART
FIG. 2 is a perspective view of an example of known rotor shaft incorporated in the compressor as shown in FIG. 1, worked out from a steel pipe.

Referring first to FIG. 1, a typical hermetic motor compressor for use in an electric refrigerator or the like, generally designated at numeral 1, has a compressor assembly 2 and a closed container 3. The compressor assembly 2 has a compression mechanism section and a driving motor section **2*b* which are disposed on and under a frame 5, respectively, and operably connected to each other through a rotor shaft 40 Referring now to FIG. 2 showing an example of the construction of the rotor shaft 4, the shaft 4 basically has a unitary construction fabricated from a steel pipe by a plastic working. More specifically, the rotor shaft 4 has at its one end an inversed-conical lubricating oil pump section 4*a* having an opening concentric with a journal section 4*c*, while the other end of the rotor shaft 4 is bent to form an eccentric section 4*b* of a preselected eccentricity. A balance weight 4*d* is secured to a portion of the journal section 4*c* in the vicinity of the eccentric section 4*b***.

A continuous and spiral oil groove **4*e* is formed in the outer peripheral surface of the journal section 4*c* by a machining or a plastic working such as press-forming. The spiral oil groove 4*e* starts from the portion of the journal section 4*c* corresponding to the lower end of a bearing section 6 of the frame, and terminates at a portion of the same just below the balance weight 4*d*. An oil port 4*f* is formed at the lower end of the oil groove 4*e* through which lubricating oil 8 coming up along the inner peripheral wall of the rotor shaft is introduced to the outer peripheral oil groove 4*e*. The portion of the rotor shaft 4 between the journal section 4c in which the oil groove 4e is formed and the oil pump section 4a constitutes a section 4g of the rotor shaft 4** for connection with the driving electric motor. In manufacturing, the rotary shaft is shaped to have respective sections by a plastic working or the like technique, and is finished by, for example, a machining.

In use, the end portion of the oil pump section 4a is immersed by a suitable length in the lubricating oil 8 in the oil pan preserved at the lower end of the closed container 3, as will be seen from FIG. 1. The arrangement is such that the lubricating oil 8 is sucked up through the opening of the oil pump section 4a, as the rotor shaft 4 rotates, and comes up along the inner peripheral wall 4h of the rotor shafts so as to be supplied to the bearing section 6, eccentric sliding section 9 and the compression mechanism section 2a.

Figure 3:
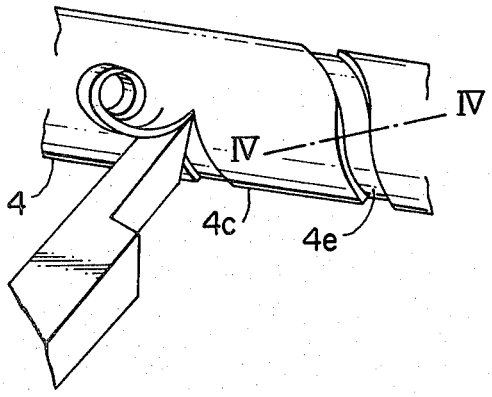
FIG. 3 PRIOR ART
FIG. 3 is a perspective view of the rotor shaft as shown in FIG. 2, under a machining for forming a peripheral oil groove.
Figure 5:
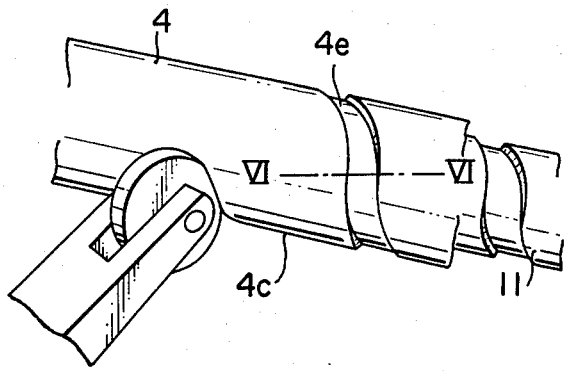
FIG. 5 PRIOR ART
FIG. 5 is a perspective view of the rotor shaft as shown in FIG. 2, under a plastic working for forming a peripheral oil groove.

In this rotor shaft 4 used in the conventional compressor 4 since the oil groove 4e is formed spirally over an axial length of the shaft 4 substantially corresponding to the axial length of the bearing section 6, the processing for forming the oil groove 4e has to be carried out in the manner as shown in FIG. 3 or FIG. 5.

Figure 4:
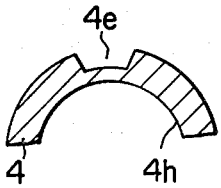
FIG. 4 PRIOR ART
FIG. 4 is a sectional view taken along the line IV—IV of FIG. 3.
Figure 6:
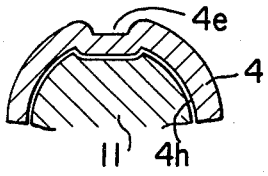
FIG. 6 PRIOR ART
FIG. 6 is a sectional view taken along the line VI—VI of FIG. 5.

Namely, according to the technique as shown in FIG. 3, the oil groove 4e of a suitable width is formed around the journal section 4c by machining, so that the shaft 4 comes to have a cross-section as shown in FIG. 4, whereas in the technique as shown in FIGS. 5 and 6, with a mandrel 11 having a spiral groove of the same pitch as the oil groove 4e of a suitable width to be formed is inserted in the pipe blank, the oil groove is formed by a rolling effected from the outside of the pipe blank. Thus, according to the latter way, the rotor shaft 4 is formed to have an internal spiral ridge as shown in FIG. 6.

These rotor shafts 4 however have had various drawbacks or shortcomings as summarized below.

(1) Usually, the use of a thin-walled pipe blank is preferred for the purpose of reducing the weight of the rotor shaft 4 itself. Thus, as the oil groove 4e is formed by a machining, the thickness of the wall of the shaft 4 is further reduced to incur an unacceptably lowered level of mechanical strength of the shaft 4, resulting possibly in a breakage of the shaft due to a fatigue of the material as the working hour of the compressor grows.

(2) The adoption of the machining as shown in FIG. 3 makes it impossible to enjoy the advantage of a continuous or simultaneous plastic working, thus deteriorating the production efficiency. In addition, the machining inconveniently requires an additional step of removing metal chips.

(3) The technique relying upon the plastic working as shown in FIG. 5 requires a mandrel 11 having outer peripheral groove, for backing-up the journal section 4c against the deformation which might, for otherwise, be caused by a considerably large external rolling force. Thus, after the formation of the oil groove 4e, it is necessary to withdraw or extract the mandrel out of the finished shaft 4. This has to be done at costs of troublesome work of pulling the mandrel while suitably rotating the same, and a complicated and long duct, which in combination make the advantage of the continuous plastic forming null.

(4) Further, a symmetrical or unbalanced residual stress is caused in the surface of the journal section 4c, after the formation of the oil groove by the plastic working. Consequently, a torsion or a twisting deformation of the shaped shaft is undesirably caused in the course of the withdrawal of the mandrel or during running of the compressor, due to the unbalanced residual stress.

The above described shortcomings or drawbacks of the prior art are fairly overcome in the motor-compressor in accordance with the invention, in which the rotor shaft basically formed, as is the case of the known compressors, from a steel pipe efficiently by a plastic working has specific forms of oil groove and sliding parts which are easy to obtain.

Hereinafter, preferred embodiments of the invention will be described with reference to FIGS. 7 through 17.

Figure 7:
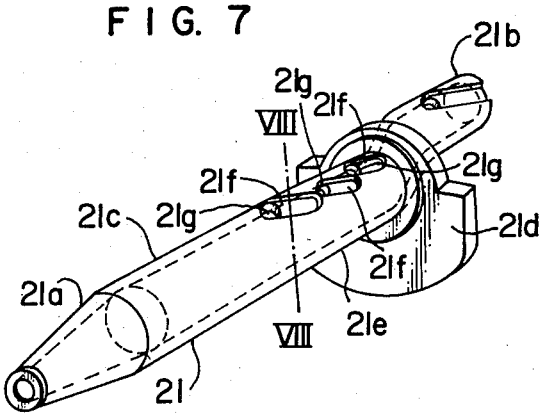
FIG. 7 is a perspective view of an example of the rotor shaft in accordance with the invention, in which are formed a plurality of oil grooves of a relatively small length having oil outlets opening in the outer periphery of the journal portion of the rotor shaft.
Figure 8:
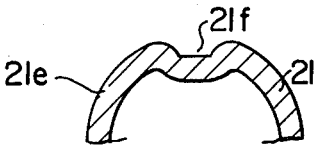
FIG. 8 is a sectional view taken along the line VIII—VIII of FIG. 7.

(1) Referring first to FIGS. 7 and 8 showing a first embodiment of the invention, a rotor shaft 21 has an oil pump section 21a, an eccentric section 21b, a portion 21c for connection to the driving electric motor, a journal section 21e and a balance weight 21d. A plurality of short oil grooves 21f of a relatively small length are press-formed in the peripheral wall of the journal section 21e, over an axial region of the latter substantially corresponding to the axial length of a bearing 22a on the frame 22. Each oil groove 21f is provided at its one end with an oil passage bore 21g through which the lubricating oil 8 coming up along the inner peripheral wall of the journal section is allowed to get out of the rotor shaft 21 and flow into the outer peripheral oil groove 21f.

Figure 9:
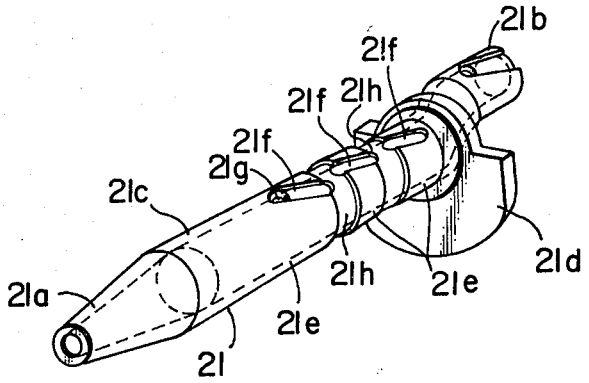
FIG. 9 is a perspective view of another rotor shaft in accordance with the invention, in which the outer peripheral surface of the journal are slightly recessed at portions thereof between adjacent oil grooves, so as to form oil-holding sections.

(2) Referring now to FIG. 9 showing another embodiment, a plurality of oil grooves 21f are press-formed on the peripheral wall of the rotor shaft 21 over an area thereof corresponding to the effective sliding surface 22a of the frame 22 excepting the upper and lower chamfered portions of the latter. At the lower end of the lowermost oil groove 21f, i.e. the oil groove 21f most remote from the balance weight, formed is an oil passage bore 21g. The outer diameter of the rotor shaft is reduced slightly at portions thereof between the adjacent oil grooves 21f to form annular oil-holding section 21h. The oil-holding section 21h has such a width or axial span that the upper end of the lower oil groove and the lower end of the upper oil groove merge the oil-holding section. At the same time, the diameter of the oil-holding section 21h is so selected as to be efficiently machined concurrently with the machining of the outer diameter of the journal section 21e.

Figure 10:
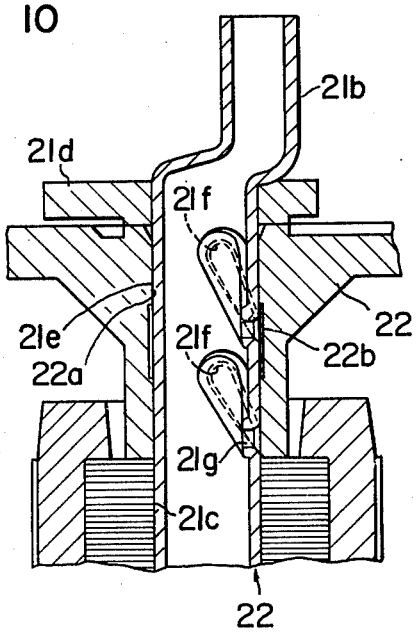
FIG. 10 is a side elevational view of a bearing construction in accordance with the invention in which oil-holding sections similar to those of FIG. 9 are formed on the frame.

(3) FIG. 10 shows a modification of the embodiment as shown in FIG. 9, in which a rotor shaft 21 having, as is in the case of the embodiment shown in FIG. 9, a plurality of oil grooves 21f of a relatively small axial length and an oil passage bore 21g is combined with a frame 22. In this case, however, the oil-holding section 22b is formed not in the peripheral surface of the rotor shaft 21 but in the inner peripheral wall of the frame 22. More specifically, the inner diameter of the frame 22 is partially increased to form the oil-holding section 22b in the form of an annular recess over such an axial length that the lower end of the upper oil groove and the upper end of the lower oil groove communicate each other through the oil-holding section 22b.

Figure 11:
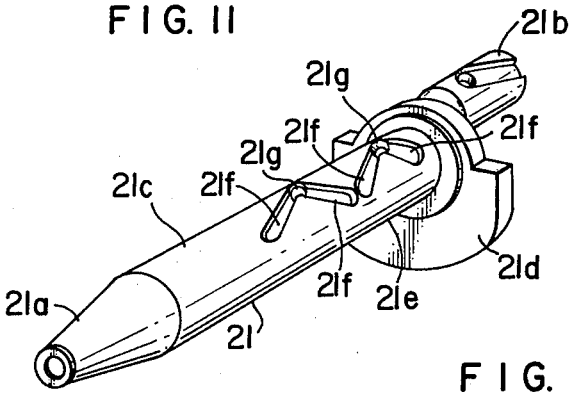
FIG. 11 is a perspective view of a rotor shaft in accordance with the invention having oil grooves curved at their intermediate portions.
Figure 12:
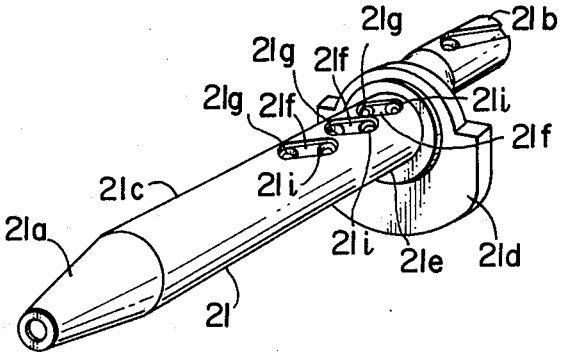
FIGS. 12, 13, 14 and 15 are perspective views of the rotor shafts as shown in FIGS. 7, 9, 10 and 11, respectively, provided with gas-escape holes.
Figure 13:
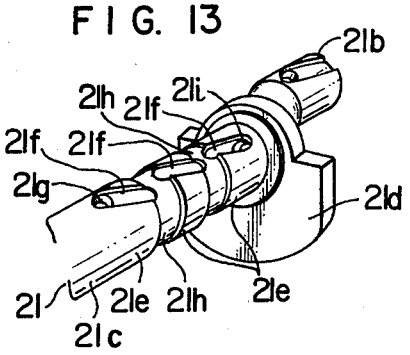
Figure 14:
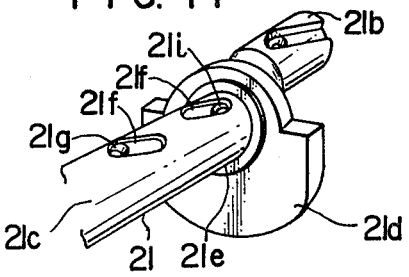
Figure 15:
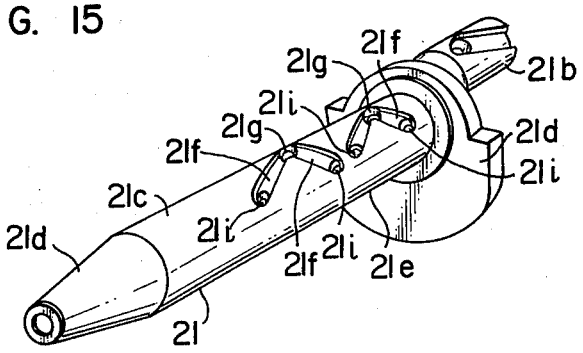

(4) Another embodiment of the invention as shown in FIG. 11 is intended for swiftly and evenly distributing the lubricating oil 8 introduced through a sole oil passage bore 21g, over the entire area of the bearing 22a. Thus, the rotor shaft according to this embodiment is provided with a plurality of press-formed oil grooves 21f, each of which is shaped to have two leg sections converging at an apex where the oil passage bore 21*g* is provided, so as to merge in each other.

(5) FIGS. 12 thru 15 show rotor shafts 21 which are modifications of the shafts as shown in FIGS. 7, 9, 10 and 11, respectively. More specifically, a gas purging port 21*i* is formed at the opposite end of the oil groove 21*f* to the oil passage bore 21*g*, so as to expel the gases which coming into the bearing section through the oil passage bore 21*g* accompanying the lubricating oil 8, would for otherwise cause a breakage of the lubricating oil film.

Figure 16:
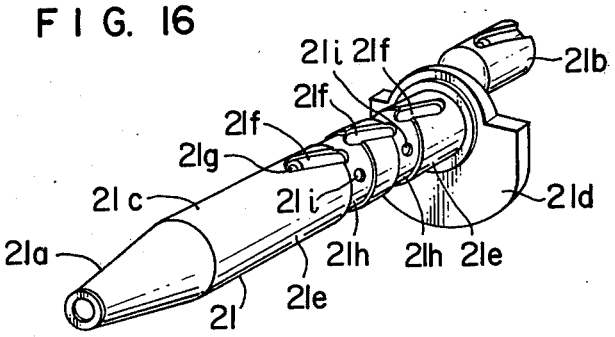
FIGS. 16 and 17 are perspective views of bearing constructions having gas escape holes formed in the oil-holding sections provided on the rotor shafts and on the frame, respectively as shown in FIGS. 9 and 10.
Figure 17:
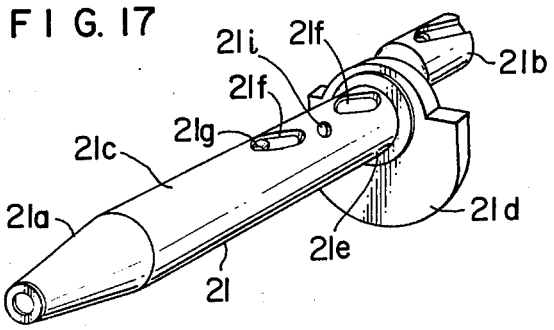

(6) FIGS. 16 and 17 show modifications of the bearing constructions as shown in FIGS. 9 and 10 having oil-holding sections 21*h* and 22*b* extending over a plurality of oil grooves 21*f*. The improvement resides in the provision of gas purging ports 21*i* in the regions of respective shafts within or covered by the oil-holding sections 21*h* or 22*b*.

Following advantages are derived from the arrangements of oil grooves and the bearing construction of the rotor shaft in accordance with the invention.

(1) In sharp contrast to the conventional continuous spiral oil groove, according to the invention, a plurality of oil grooves 21*f* of a relatively small length are formed in the peripheral surface of the journal section at a suitable inclination to the direction of rotation, i.e. the circumferential direction of the rotor shaft 21. Therefore, the axial length of the grooved portion of the mandrel to be inserted is conveniently reduced to facilitate the withdrawal of the mandrel after the press-forming of the oil groove 21*f*. Consequently, it becomes possible to form the rotary shaft 21 to its final shape through a continuous plastic working process, thus eliminating the necessity of mechanical processing such as machining which contains various problems in both aspects of processing and performance of the final product.

(2) The oil-holding sections 21*h* or 22*b* bridging over the adjacent oil grooves 21*f* constitutes passages of lubricating oil 8 fed through the oil passage bore. Thus, the safe supply of the lubricating oil 8 to whole part of the bearing is ensured by only one oil passage bore. In other words, the number of oil passage bores can be minimized according to the invention. This feature is of a great significance, because the oil passage bore, which are formed across the wall of the rotor shaft seriously affects the mechanical strength of the latter.

(3) In case of the press-formed oil groove 21*f* as shown in FIG. 11 having two leg sections converging at the oil passage bore 21*g*, the lubricating oil 8 fed through the bore 21*g* is allowed to flow into the leg sections without being encountered by substantial flow resistance. Consequently, the oil is distributed and spread over the area of the bearing in a shorter time, to establish an effective oil film shortly after the start of the compressor, contributing greatly to prevent seizure or other accident in the bearing section which tends to take place during the running in or soon after the start of the compressor.

(4) The oil coming through the oil passage bore 21*g* is accompanied by a gas which is generated by the stirring action of the rotor shaft 21 on the lubricating oil. It is often experienced that the gas introduced into the bearing section is concentrated to form bubbles or voids to instantaneously break the oil film. However, according to the invention, this problem is fairly overcome by the provision of the gas purging port at the upper end portion of the oil groove 21*f* or at the portion of the journal section 21*e* in the vicinity of the oil holding section 21*h* or 22*b*, for effectively purging the gas from the inside of the bearing. Thus, the gas purging bore is effective to prevent seizure or other accident in the bearing section during the running of the compressor.

It will be seen from the foregoing description that the present invention provides an improved sliding mechanism of a rotor shaft basically made of a steel pipe, having a specific form of oil grooves or bearing construction, while preserving the advantage of efficient and continuous plastic working in the processing of the rotor shaft, contributing greatly to the production of the hermetic motor-compressor.

Having described the invention in its preferred forms, it is to be noted here that various changes and modifications are possible without departing the spirit and scope of the invention which are limited solely by the appended claims.

What is claimed is:

1. A hermetic motor-compressor of a relatively small capacity, comprising a compressor assembly including a compression mechanism section and a driving electric motor section which are confined in a closed container, and an essentially vertical rotor shaft operatively connecting said compression mechanism and said driving electric motor section, said rotor shaft being formed from a single steel pipe which has been plastically worked to have an eccentric section at one end, an oil pump section at the other end and an intermediate journal section and being provided with a separate balance weight, said compressor assembly further having a bearing section adapted for cooperating with said rotor shaft, characterized by comprising a plurality of oil grooves press-formed from the outside of said rotor shaft in the outer peripheral surface of said rotor shaft, so that the lubricating oil sucked up by said pump section is delivered to said oil grooves through at least one oil passage bore formed through the wall of said journal section of said rotor shaft and distributed to said bearing section to lubricate the latter, the outer diameter of said rotor shaft being reduced at a portion or portions of said journal section between adjacent oil grooves to form at least one annular groove constituting an oil holding section, said oil holding section having such a width or length in the axial direction of said rotor shaft that the annular groove of said oil holding section extends beyond and partly overlaps the upper end of the lower oil groove and the lower end of the upper oil groove, whereby the lubricating oil is delivered from one oil groove to the other through said oil holding section to lubricate the whole part of said bearing section, and wherein at least one gas purging port is provided for expelling the gas introduced through said oil passage bore along with the lubricating oil, said gas purging port being formed through the wall of said rotor shaft in the annular groove of said oil holding section.

* * * * *